US007211954B2

(12) United States Patent
Ramaiah et al.

(10) Patent No.: US 7,211,954 B2
(45) Date of Patent: May 1, 2007

(54) DISCHARGE TUBES

(75) Inventors: Raghu Ramaiah, Euclid, OH (US); Benton Bartley Oukrop, Jeffersonville, IN (US); Matthew Bugenske, Cleveland Heights, OH (US); Gary W. Utterback, University Heights, OH (US); Tom Boyle, Lyndhurst, OH (US); Balaji Parthasarathy, Bangalore (IN); Karthik Sivaraman, Mayfield Village, OH (US)

(73) Assignee: General Electric Company, Schenectady, NY (US)

( * ) Notice: Subject to any disclaimer, the term of this patent is extended or adjusted under 35 U.S.C. 154(b) by 252 days.

(21) Appl. No.: 11/075,598

(22) Filed: Mar. 9, 2005

(65) Prior Publication Data

US 2006/0202623 A1 Sep. 14, 2006

(51) Int. Cl.
*H01J 17/18* (2006.01)
*H01J 61/36* (2006.01)

(52) U.S. Cl. ..... 313/625; 313/623; 313/624

(58) Field of Classification Search ..... 313/493, 313/623–626, 631, 634, 636, 638, 331–332, 313/573–574

See application file for complete search history.

(56) References Cited

U.S. PATENT DOCUMENTS

| | | | |
|---|---|---|---|
| 4,734,612 | A | 3/1988 | Sasaki et al. |
| 4,749,905 | A | 6/1988 | Mori et al. |
| 4,910,432 | A | 3/1990 | Brown et al. |
| 5,424,609 | A | 6/1995 | Geven et al. |
| 5,879,215 | A | 3/1999 | Duffy et al. |
| 5,973,453 | A | 10/1999 | Van Vliet et al. |
| 6,137,229 | A | 10/2000 | Nishiura et al. |
| 6,172,462 | B1 | 1/2001 | Gibson et al. |
| 6,259,205 | B1 | 7/2001 | Wijenberg et al. |
| 2003/0096551 | A1 | 5/2003 | Miyazawa et al. |
| 2003/0193281 | A1 | 10/2003 | Manning |

FOREIGN PATENT DOCUMENTS

| | | |
|---|---|---|
| EP | 0 286 247 A1 | 10/1988 |
| EP | 0 215 524 B1 | 7/1989 |
| EP | 0 286 247 B1 | 1/1991 |
| EP | 0 587 238 A1 | 3/1994 |
| EP | 0 869 540 A1 | 10/1998 |
| EP | 0 587 238 B1 | 7/2000 |
| EP | 0 841 687 B1 | 1/2003 |
| JP | 62-283543 | 12/1987 |
| JP | 09-283083 | 10/1997 |
| WO | WO99/41761 | 8/1999 |
| WO | WO 02/091431 A2 | 11/2002 |

*Primary Examiner*—Joseph Williams
(74) *Attorney, Agent, or Firm*—Pearne & Gordon LLP

(57) ABSTRACT

Discharge tubes for a lamp include a body portion with a first end, a second end, and a tubular member defining an interior area. The tubular member extends along an elongated axis between the first end and the second end. The discharge tube includes a first end portion provided at the first end of the body portion. The first end portion includes a first tapered portion that is tapered in a direction extending substantially perpendicular from the elongated axis. The first tapered portion includes an interior surface facing the interior area. The tapered portion spans between a maximum extent in the direction of the elongated axis and a minimum extent in the direction of the elongated axis.

24 Claims, 6 Drawing Sheets

DISCHARGE TUBES

FIELD OF THE INVENTION

The present invention relates to illumination components, and more particularly to discharge tubes for a lamp.

BACKGROUND OF THE INVENTION

Certain lamps are known to include a discharge tube to facilitate the illumination function. For example, U.S. Pat. No. 6,137,229 discloses a conventional metal halide lamp with a ceramic discharge tube. As shown in U.S. Pat. No. 6,137,229, end portions of conventional discharge tubes are known to comprise ring portions with a wall thickness based on the power supplied to the lamp.

FIGS. 1 and 2 depict a further example of a conventional ceramic discharge tube 160. As shown, the discharge tube 160 includes end portions 164*a*, 164*b* disposed on opposite circumferential end portions of a substantially cylindrical tubular member 162. The discharge tube 160 is symmetrically disposed about an elongated axis 158 and includes an outer radius "r" of 9.35 millimeters. Each end portion 164*a*, 164*b* is substantially identical and includes a transition section 168 between a ring portion 173 and a tubular extension 166. The transition section spans between a maximum extent 168*a* in the direction of the elongated axis 158 and a minimum extent 168*b* in the direction of the elongated axis 158. The minimum extent 168*b* has a first dimension "$d_1$" of 1.5 millimeters with respect to an interior surface 172. The maximum extent 168*a* has a second dimension "$d_2$" of 3.4 millimeters with respect to the interior surface 172.

Conventional end portions can have features that result in cracking due to heat-cycles during the lamp lifetime. There is a continued need to provide discharge tubes with features that inhibit cracking of one or more end portions of discharge tubes.

SUMMARY OF THE INVENTION

In accordance with one aspect, a discharge tube for a lamp comprises a body portion including a first end, a second end, and a tubular member defining an interior area. The tubular member extends along an elongated axis between the first end and the second end. The discharge tube includes a first end portion provided at the first end of the body portion. The first end portion includes a first tapered portion that is tapered in a direction extending substantially perpendicular from the elongated axis. The first tapered portion includes an interior surface facing the interior area. The tapered portion spans between a maximum extent in the direction of the elongated axis and a minimum extent in the direction of the elongated axis. The minimum extent includes a first dimension $D_1$ with respect to the interior surface and the maximum extent includes a second dimension $D_2$ with respect to the interior surface. The ratio $D_1/D_2$ is from about 0.07 to 0.43.

In accordance with another aspect, a discharge tube for a lamp comprises a body portion including a first end, a second end, and a tubular member defining an interior area. The tubular member extends along an elongated axis between the first end and the second end and the discharge tube has a circular periphery disposed at a radius "R" about the elongated axis. The discharge tube further comprises a first end portion provided at the first end of the body portion. The first end portion includes a first tapered portion that is tapered in a direction extending substantially perpendicular from the elongated axis. The first tapered portion includes an interior surface facing the interior area. The tapered portion spans between a maximum extent in the direction of the elongated axis and a minimum extent in the direction of the elongated axis. The minimum extent includes a first dimension $D_1$ with respect to the interior surface and the maximum extent includes a second dimension $D_2$ with respect to the interior surface wherein the ratio $D_2/R$ is from 0.40 to about 2.2.

In accordance with a further aspect, a discharge tube for a lamp comprises a body portion including a first end, a second end, and a tubular member defining an interior area. The tubular member extends along an elongated axis between the first end and the second end and the discharge tube has a circular periphery disposed at a radius "R" about the elongated axis. The discharge tube further includes a first end portion provided at the first end of the body portion. The first end portion includes a first tapered portion that is tapered in a direction extending substantially perpendicular from the elongated axis. The first tapered portion includes an interior surface facing the interior area and the tapered portion spans between a maximum extent in the direction of the elongated axis and a minimum extent in the direction of the elongated axis. The minimum extent includes a first dimension $D_1$ with respect to the interior surface and the maximum extent includes a second dimension $D_2$ with respect to the interior surface, wherein the ratio $D_1/D_2$ is from about 0.18 to about 0.25 and the ratio $D_2/R$ is from about 0.8 to about 0.9.

DETAILED DESCRIPTION OF EXAMPLE EMBODIMENTS

Figure 1:
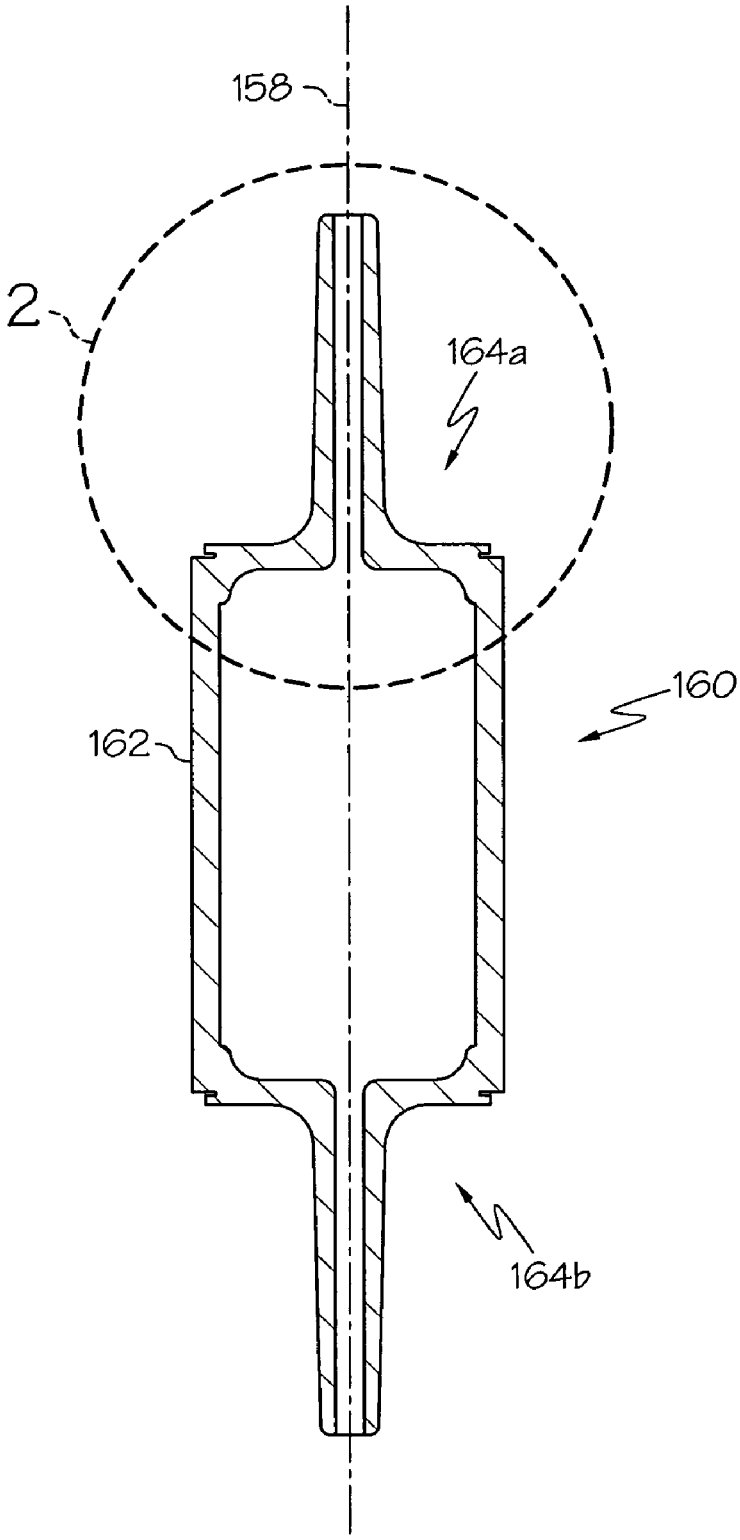
FIG. 1 (PRIOR ART)
FIG. 1 is a cross sectional view of a conventional discharge tube.
Figure 2:
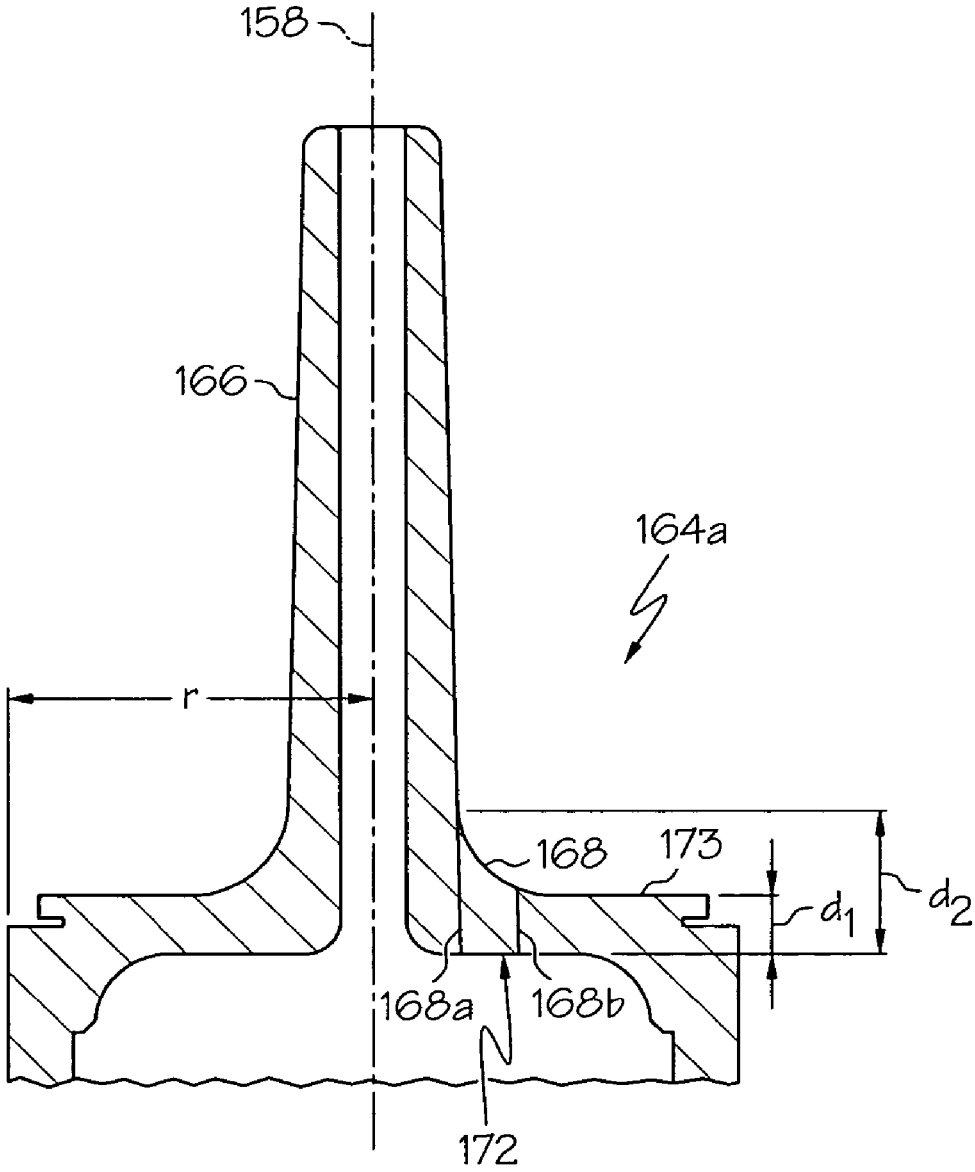
FIG. 2 (PRIOR ART)
FIG. 2 is an enlarged view of portions of the conventional discharge tube taken at view 2 of FIG. 1.
Figure 3:
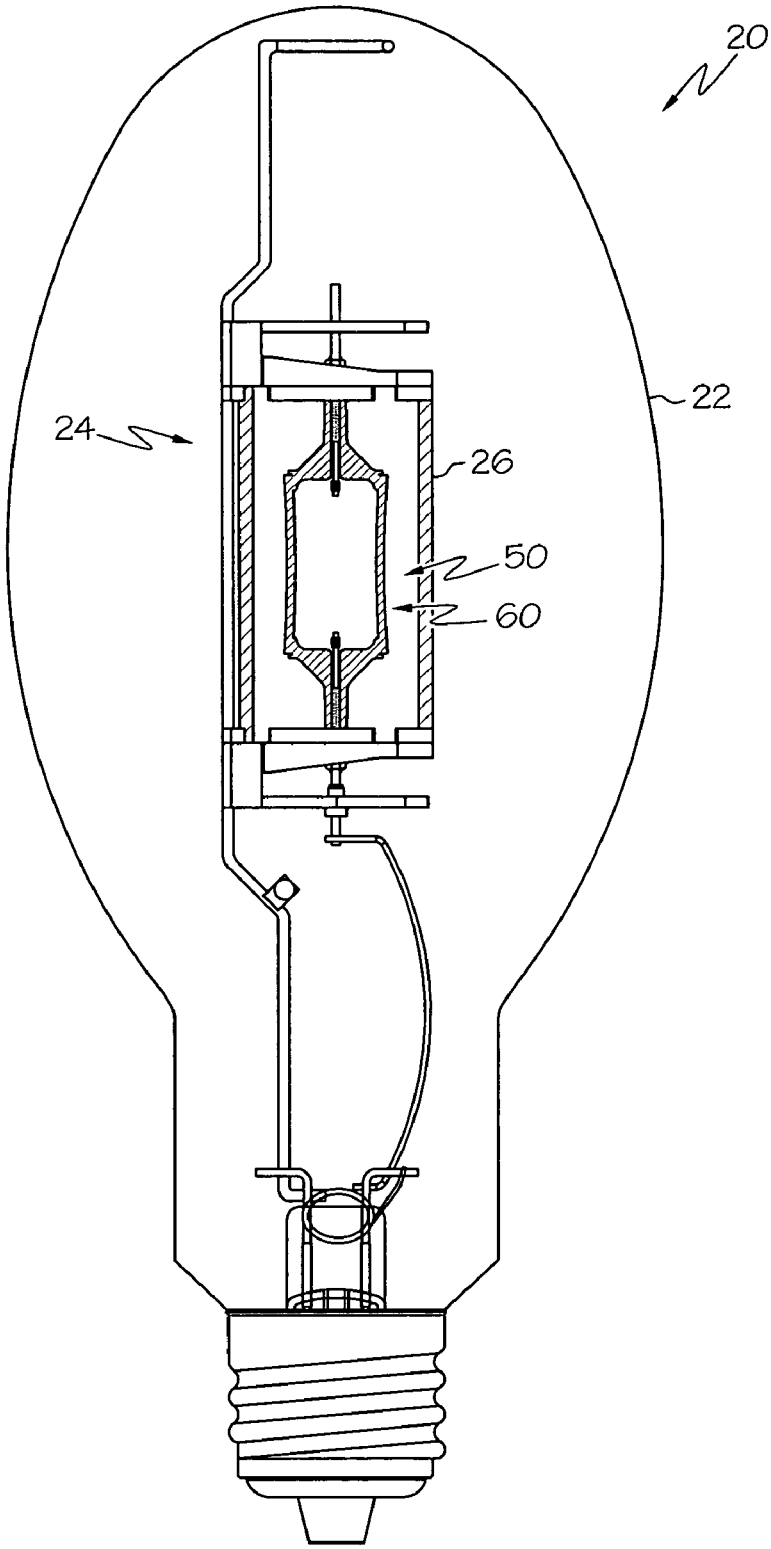
FIG. 3 is a partial sectional view of an exemplary lamp including a discharge tube assembly with a discharge tube in accordance with an exemplary embodiment of the invention.

Discharge tubes of the present invention may be used as an illumination component in a wide variety of lamps having various structures, shapes, sizes, components and/or configurations. Just one example of a lamp 20 incorporating concepts of the present invention is illustrated in FIG. 3. The illustrative lamp 20 incorporates a discharge tube assembly 50 comprising a discharge tube 60 in accordance with the present invention. The lamp 20 can include an optional protective feature, such as a transparent quartz shroud 26, designed to contain explosions that might occur during a failure of the discharge tube 50. The lamp 20 can also include a support structure 24 designed to suspend the discharge tube assembly 50 within the interior area defined by outer bulb 22. Discharge tubes in accordance with the present invention may be used with a lamp having a power level of about 150 Watts or greater. In further examples, discharge tubes in accordance with the present invention may be used with a lamp having a power level of about 250

Watts or greater. In still further embodiments, discharge tubes in accordance with the present invention may be used with lamps having a lower power level.

Figure 4:
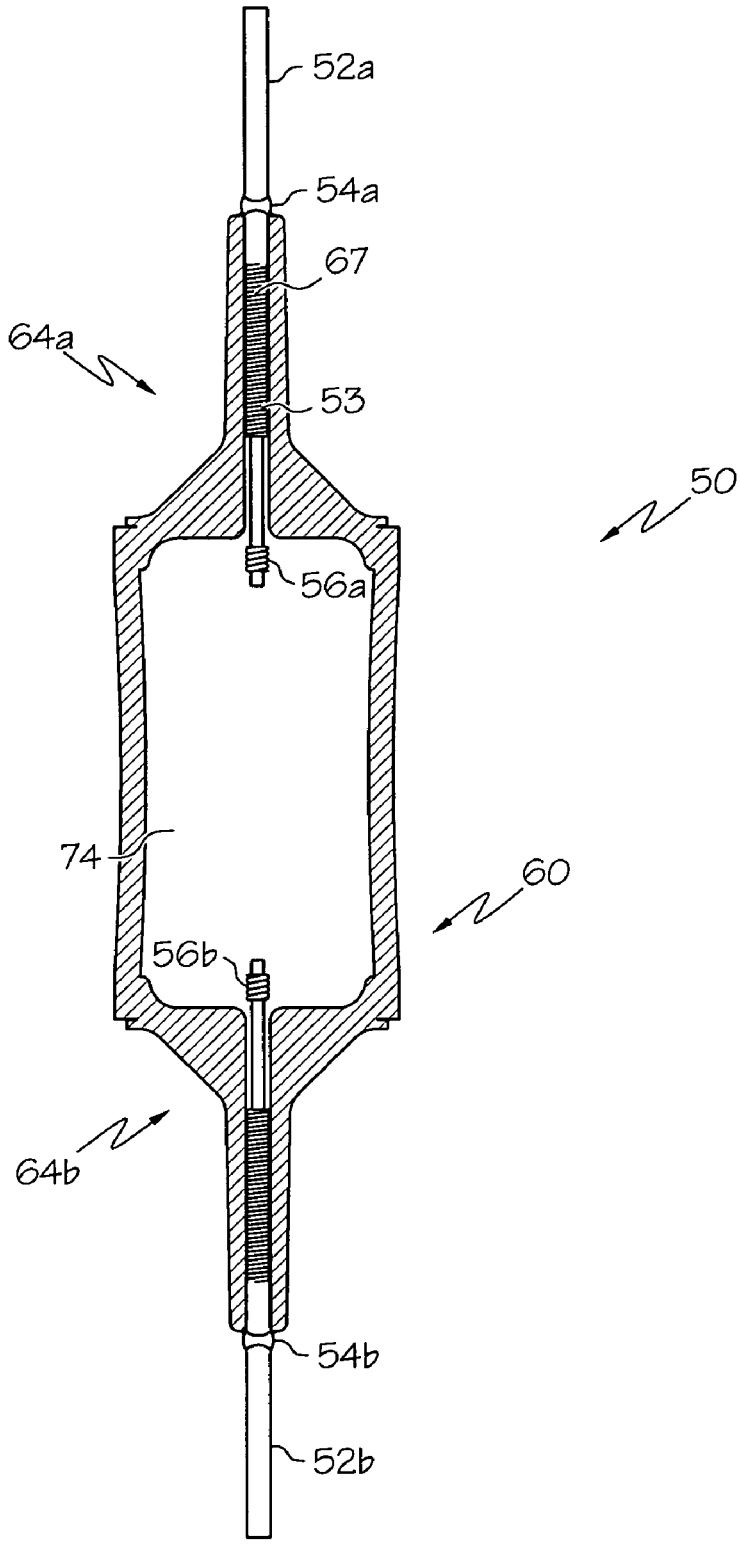
FIG. 4 is a partial sectional view of the discharge tube assembly of FIG. 3.

Discharge tubes of the present invention may also be used as an illumination component in a wide variety of discharge tube assemblies having various structures, shapes, sizes, components and/or configurations. FIG. 4 illustrates just one example of a discharge tube assembly 50 having an exemplary discharge tube 60 incorporating aspects of the present invention. The discharge tube 60 defines an interior area 74 that can act as a discharge location for the lamp. The interior area 74 may be filled with an ionizable filling, such as various metal halides that are known for use with metal halide lamps. A first electrode 56*a* and a second electrode 56*b* can be positioned within the interior area 74. The first and second electrodes 56*a*, 56*b* can comprise a winding of tungsten wire that is wrapped around respective lead-in wires 52*a*, 52*b*. The lead-in wires might be formed of a niobium material and can include a winding 53 of molybdenum material. Each lead-in wire 52*a*, 52*b* extends through respective through passages 67 of end portions 64*a*, 64*b* of the discharge tube 60. Once appropriately positioned, a seal 54*a*, 54*b* may be applied to seal any interstitial space between the lead-in wires and the through passage. The seals 54*a*, 54*b* can comprise a ceramic sealing compound in exemplary embodiments.

Figure 5:
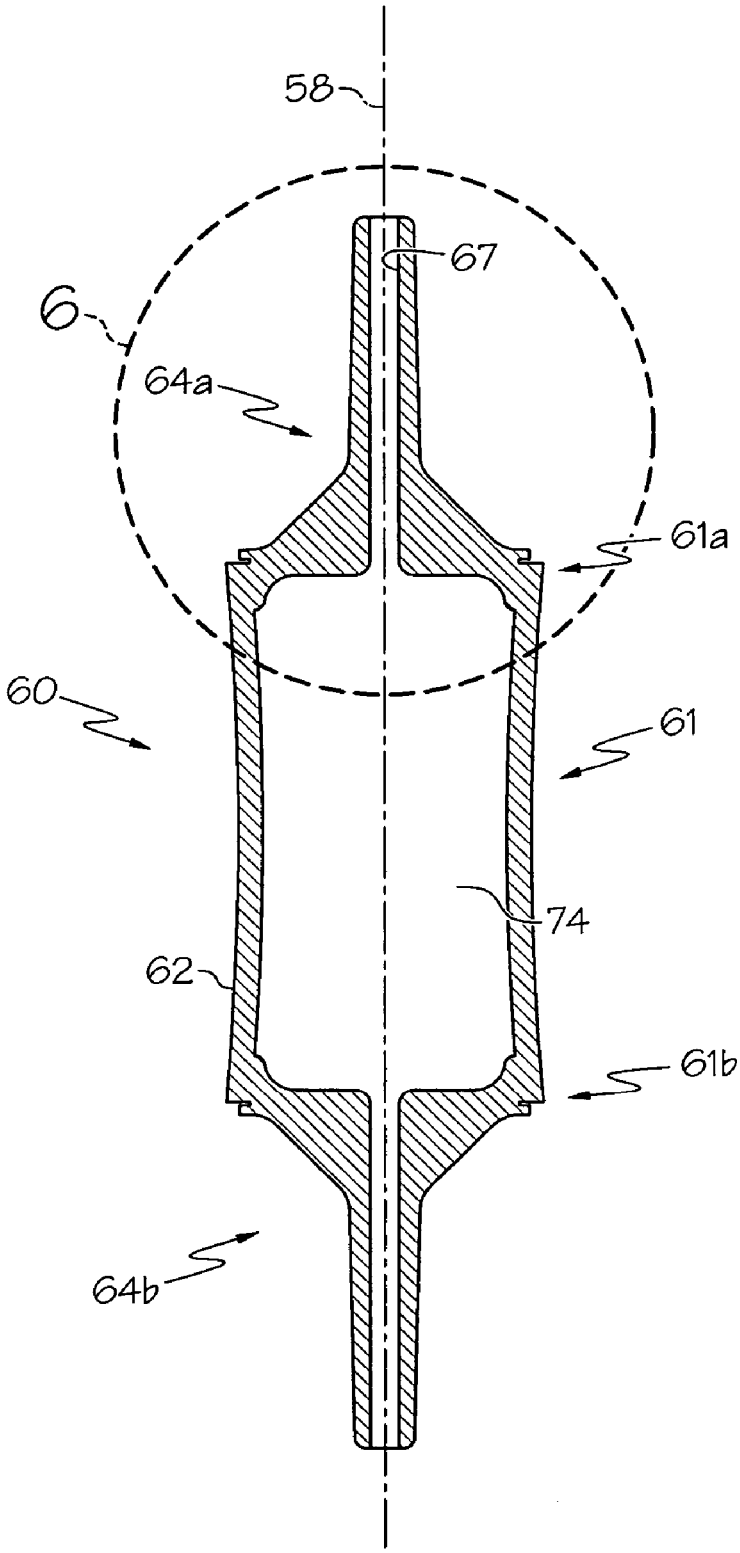
FIG. 5 is a sectional view of the discharge tube illustrated in FIGS. 3 and 4.
Figure 6:
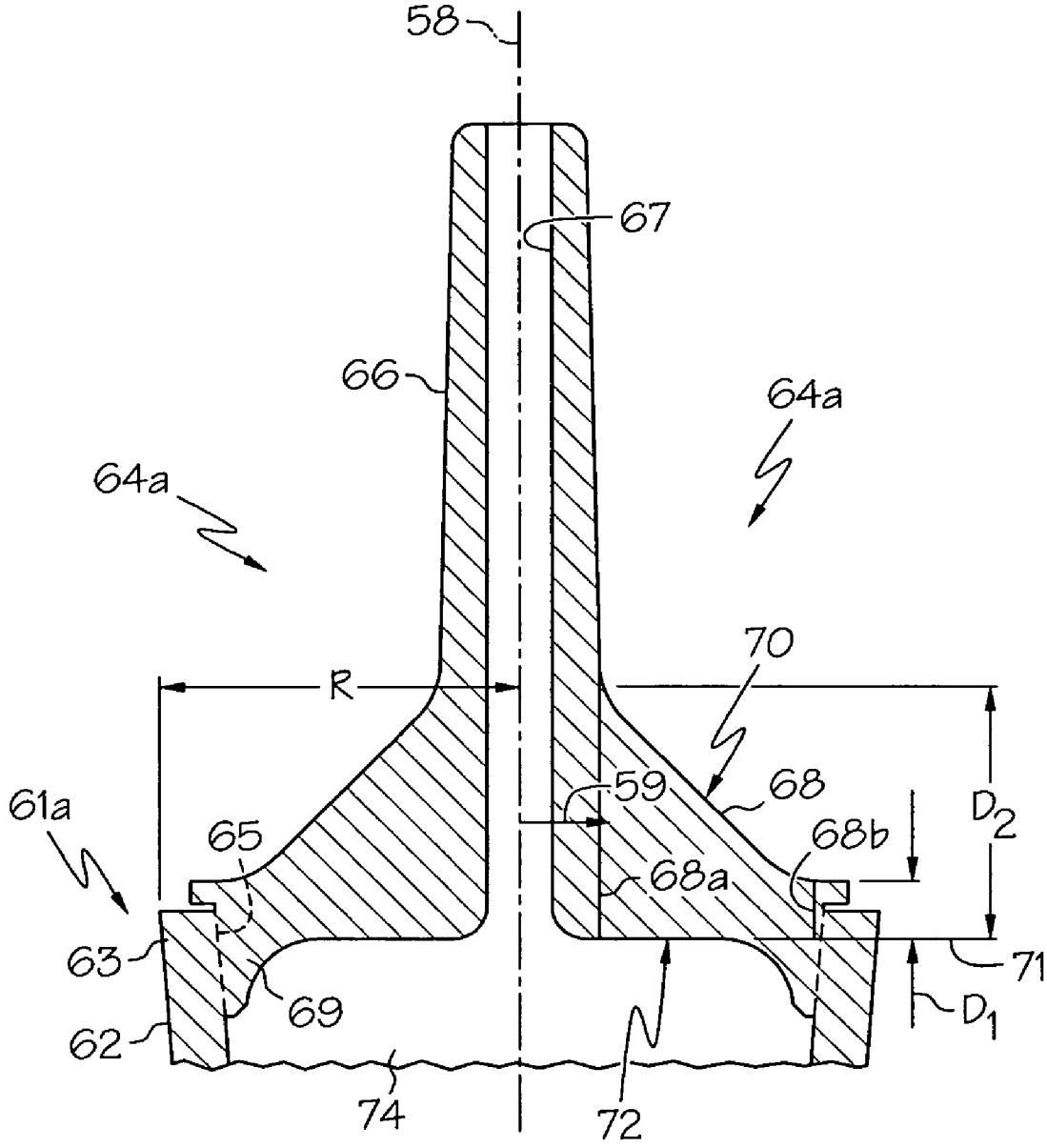
FIG. 6 is an enlarged view of portions of the discharge tube taken at view 6 of FIG. 5.

FIGS. 5 and 6 illustrate the exemplary discharge tube 60 incorporating concepts of the present invention. As shown, the discharge tube 60 includes a body portion 61 with a first end 61*a* and a second end 61*b*. The body portion 61 further includes a tubular member 62 defining the interior area 74. The tubular member 62 extends along an elongated axis 58 between the first end 61*a* and the second end 61*b* of the body portion 61.

Exemplary discharge tubes in accordance with the present invention can comprise tubular members having a wide variety of shapes, sizes and can be oriented in a variety of positions with respect to other components of the discharge tube. In the illustrated embodiment, the tubular member 62 is substantially symmetrically disposed about the elongated axis 58 although it is contemplated that the tubular members may also be asymmetrically or otherwise disposed about the elongated axis 58 in further embodiments of the present invention. In the illustrated embodiment, the tubular members comprise circular peripheries along cross sections that are substantially perpendicular to the elongated axis 58. The circular peripheries may have a constant radius or a varying radius. In the illustrated embodiment, the radius is smaller towards a central section of the tubular member and gets larger toward each end (e.g., see reference number 63 in FIG. 6). It is contemplated that the tubular member may have substantially the same radius along the entire length. The tubular member can also be formed as a bulbous portion or may be formed without circular peripheries and therefore might not include a radius dimension from the elongated axis. For example, the tubular members can have an at least partially rectilinear periphery such as a polygonal periphery (e.g., triangular, rectangular, square or other polygonal arrangement).

Discharge tubes in accordance with the present invention can include an end portion or a plurality of end portions. For example, a plurality of end portions can be provided with similar or substantially identical structural features. Alternatively, the plurality of end portions may comprise different structural features wherein at least one end portion incorporates aspects of the present invention. Discharge tubes can also include a single end portion incorporating aspects of the present invention. For example, the tubular member can comprise a closed end tube wherein only one end of the tube includes an end portion in accordance with aspects of the present invention.

As shown in FIG. 5, the illustrated example depicts a first end portion 64*a* provided at the first end 61*a* of the body portion 61 and a second end portion 64*b* provided at the second end 61*b* of the body portion 61. In the illustrated example, the first and second end portions 64*a*, 64*b* are substantially identical to one another. As shown in FIG. 6, the first end portion 64*a* includes a tapered portion 68 that is tapered in a direction 59 extending substantially perpendicular from the elongated axis 58. The tapered portion 68 includes an interior surface 72 facing the interior area 74. The interior surface 72 can comprise a substantially flat surface and can extend substantially perpendicular from the elongated axis 58. In alternative embodiments, the interior surface 72 may comprise a nonplanar surface and/or can extend at an angle other than 90 degrees from the elongated axis 58.

The tapered portion 68 spans between a maximum extent 68*a* in the direction of the elongated axis 58 and a minimum extent 68*b* in the direction of the elongated axis 58. For example, as shown the maximum and minimum extent 68*a*, 68*b* can extend substantially parallel with respect to the elongated axis. The minimum extent 68*b* includes a first dimension $D_1$ with respect to the interior surface 72 and the maximum extent 68*a* includes a second dimension $D_2$ with respect to the interior surface 72. For example, as shown, the first and second dimensions $D_1$, $D_2$ can be measured with respect to a plane 71 along which the interior surface 72 extends.

Discharge tubes in accordance with aspects of the present invention can have various shapes and sizes depending how the tapered portion spans from the maximum extent to the minimum extent. As shown in FIG. 6, the tapered portion tapers in the direction 59 that is perpendicular from the elongated axis to form a surface 70. In exemplary embodiments, the surface 70 can comprise a flat surface when the tapered portion does not extend perpendicularly from the elongated axis in all directions. In the illustrated embodiment, the tapered portion tapers in all directions that are perpendicular from the elongated axis to form a conical surface 70. The conical surface 70 can have a variety of surface characteristics to provide a linear, convex, concave, stepped or other conical surface arrangements. In the illustrated embodiment, the tapered portion 68 comprises a linear conical surface 70 that faces away from the interior area 74 of the tubular member.

The first and second dimensions can have a wide range of values depending on the size of the discharge tube. Regardless of the size of the discharge tube, exemplary embodiments of discharge tubes in accordance with the present invention can be arranged with a ratio between $D_1$ and $D_2$ that can inhibit cracking of the end portion. For example, a ratio $D_1/D_2$ from about 0.07 to 0.43 can inhibit cracking of the end portion during heating and/or cooling. In another example, a ratio $D_1/D_2$ from about 0.15 to about 0.3 can inhibit cracking of the end portion during heating and/or cooling. In a further example, a ratio $D_1/D_2$ from about 0.18 to about 0.25 can inhibit cracking of the end portion during heating and/or cooling. Providing ratios $D_1/D_2$ within the ranges above can reduce stresses resulting from temperature differentials as the discharge tube heats when the lamp is turned on and/or as the discharge tube cools after the lamp is turned off.

In exemplary embodiments, the first dimension $D_1$ can range from about 1 millimeter to about 4 millimeters. In additional embodiments, the first dimension $D_1$ can range from about 1 millimeter to about 2 millimeters. In further embodiments, the first dimension $D_1$ can range below 1 millimeter or above 4 millimeters depending on the size of the lamp. One example of a discharge tube can have a first dimension $D_1$ of about 1.5 millimeters and a second dimension $D_2$ of about 8 millimeters wherein the ratio $D_1/D_2$ is about 0.19. It is further understood that the first dimension $D_1$ can be selected based on the desired size of the lamp wherein the second dimension $D_2$ can be determined to provide a ratio $D_1/D_2$ within a range discussed above to inhibit cracking of the discharge tube.

Exemplary embodiments of the invention can also include a discharge tube that has various periphery shapes, such as a circular periphery disposed at a radius "R" about the elongated axis. If the discharge tube has a circular periphery, the ratio between the second dimension $D_2$ and the radius "R" can be provided within a range to reduce stresses after the lamp is turned off. Thus, if the discharge tube has a circular periphery, the ratio $D_2/R$ and/or the ratio $D_1/D_2$ can be provided within ranges discussed herein to reduce stresses when turning the lamp on and/or when turning the lamp off. For example, in the illustrated embodiment, the discharge tube 60 has a circular periphery 63 disposed at a radius "R" about the elongated axis 58. The radius "R" can have a wide range of values depending on the size of the discharge tube. Regardless of the size of the discharge tube, exemplary embodiments of discharge tubes in accordance with the present invention can have a ratio between $D_2$ and "R" that can inhibit cracking of the end portion. For example, a ratio $D_2/R$ from 0.40 to about 2.2 can inhibit cracking of the end portion during heating and/or cooling. In another example, a ratio $D_2/R$ from about 0.5 to about 1 can inhibit cracking of the end portion during heating and/or cooling. In a further example, a ratio $D_2/R$ from about 0.8 to about 0.9 can inhibit cracking of the end portion during heating and/or cooling. Providing a ratio $D_2/R$ within the ranges above can reduce stresses resulting from temperature differentials as the discharge tube heats when the lamp is turned on and/or as the discharge tube cools after the lamp is turned off.

In exemplary embodiments, the radius "R" can range from about 4 millimeters to about 15 millimeters. In further embodiments, the radius "R" can range below 4 millimeters or above 15 millimeters depending on the size of the lamp. One example of a discharge tube can have a radius "R" of about 9.35 millimeters and a second dimension $D_2$ of about 8 millimeters wherein the ratio $D_2/R$ is about 0.86. It is further understood that the radius "R" can be selected based on the desired size of the lamp wherein the second dimension $D_2$ can be determined to provide a ratio $D_2/R$ within a range discussed above to inhibit cracking of the discharge tube.

If the discharge tube has a circular periphery, the ratio $D_2/R$ and/or the ratio $D_1/D_2$ can be provided within ranges discussed above. In addition, a discharge tube with a circular periphery can include ratios $D_2/R$ and $D_1/D_2$ that both fall within any of the ranges discussed above to inhibit cracking during heating and/or cooling of the end portion. For example, a discharge tube may be provided wherein the ratio $D_2/R$ is from 0.40 to about 2.2 and the ratio $D_1/D_2$ is from about 0.07 to 0.43. In another example, the ratio $D_2/R$ is from about 0.5 to about 1 and the ratio $D_1/D_2$ is from about 0.15 to about 0.3. In a further example, the ratio $D_2/R$ is from about 0.8 to about 0.9 and the ratio $D_1/D_2$ is from about 0.18 to about 0.25.

In further exemplary embodiments, the end portions can include a tubular extension extending from the tapered portion. For example, as shown in FIG. 6, the first end portion 64*a* includes a tubular extension 66 extending from the tapered portion 68. The first end portion 64*a* can further include one or more through passages to accommodate one or more lead-in wires. In embodiments with a single end portion, two or more through passages may be provided or a single through passage can be provided that is sufficient to accommodate both lead-in wires. In the illustrated exemplary embodiment, each end portion 64*a* includes a single through passage 67 that extends through the tubular extension 66 and the tapered portion 68 along the elongated axis 58.

The discharge tube in accordance with the present invention may be formed from a wide range of materials and processes while incorporating the concepts of the present invention. For example, the discharge tube can be formed from a ceramic material although other materials can be used to facilitate appropriate lamp function. If fabricated from ceramic, the ceramic material can comprise AL203, Y203 or YAG ceramic material although other ceramic materials are contemplated. The tubular member can also be initially formed separately from the end portions for later assembly. For example, the tubular member 62 can be formed and cut to the desired length. As shown in FIG. 6, each end portion can have a circumferential lip 69 designed to fit within a corresponding end of the tubular member 62. Once the end portions are in place, the assembly can be sintered together wherein the end portions are attached to the tubular member at a sintered location 65. It is understood that other process techniques may be used to form the discharge tube in accordance with concepts of the present invention.

From the above description of the invention, those skilled in the art will perceive improvements, changes and modifications. Such improvements, changes and modifications within the skill of the art are intended to be covered by the appended claims.

What is claimed:

1. A discharge tube for a lamp comprising:

a body portion including a first end, a second end, and a tubular member defining an interior area, wherein the tubular member extends along an elongated axis between the first end and the second end; and a first end portion provided at the first end of the body portion, the first end portion including a first tapered portion that is tapered in a direction extending substantially perpendicular from the elongated axis, the first tapered portion including an interior surface facing the interior area, wherein the tapered portion spans between a maximum extent in the direction of the elongated axis and a minimum extent in the direction of the elongated axis, the minimum extent including a first dimension $D_1$ with respect to the interior surface and the maximum extent including a second dimension $D_2$ with respect to the interior surface, wherein the ratio $D_1/D_2$ is from about 0.07 to 0.43.

2. The discharge tube of claim 1, wherein the ratio $D_1/D_2$ is from about 0.15 to about 0.3.

3. The discharge tube of claim 1, wherein the ratio $D_1/D_2$ is from about 0.18 to about 0.25.

4. The discharge tube of claim 1, wherein the first dimension $D_1$ is from about 1 millimeter to about 4 millimeters.

5. The discharge tube of claim 1, wherein the discharge tube has a circular periphery disposed at a radius "R" about the elongated axis, wherein the ratio $D_2/R$ is from 0.40 to about 2.2.

6. The discharge tube of claim 5, wherein the ratio $D_2/R$ is from about 0.5 to about 1.

7. The discharge tube of claim 6, wherein the ratio $D_2/R$ is from about 0.8 to about 0.9.

8. The discharge tube of claim 5, wherein the radius "R" is from about 4 millimeters to about 15 millimeters.

9. The discharge tube of claim 1, wherein the tubular member is substantially symmetrically disposed about the elongated axis.

10. The discharge tube of claim 1, further comprising a second end portion provided at the second end of the body portion, the second end portion including a second tapered portion that is tapered in the direction extending substantially perpendicular from the elongated axis.

11. The discharge tube of claim 1, wherein the first end portion includes a tubular extension extending from the first tapered portion, wherein a through passage extends through the tubular extension and the first tapered portion along the elongated axis.

12. The discharge tube of claim 1, wherein the first tapered portion is tapered in all directions extending substantially perpendicular from the elongated axis.

13. The discharge tube of claim 1, wherein the first tapered portion comprises a conical surface.

14. The discharge tube of claim 13, wherein the conical surface comprises a linear conical surface.

15. The discharge tube of claim 1, wherein the interior surface comprises a substantially planar surface.

16. The discharge tube of claim 1, wherein the discharge tube comprises a ceramic material.

17. A discharge tube for a lamp comprising:

a body portion including a first end, a second end, and a tubular member defining an interior area, wherein the tubular member extends along an elongated axis between the first end and the second end, wherein the discharge tube has a circular periphery disposed at a radius "R" about the elongated axis; and a first end portion provided at the first end of the body portion, the first end portion including a first tapered portion that is tapered in a direction extending substantially perpendicular from the elongated axis, the first tapered portion including an interior surface facing the interior area, wherein the tapered portion spans between a maximum extent in the direction of the elongated axis and a minimum extent in the direction of the elongated axis, the minimum extent including a first dimension $D_1$ with respect to the interior surface and the maximum extent including a second dimension $D_2$ with respect to the interior surface wherein the ratio $D_2/R$ is from 0.40 to about 2.2.

18. The discharge tube of claim 17, wherein the ratio $D_2/R$ is from about 0.5 to about 1.

19. The discharge tube of claim 17, wherein the ratio $D_2/R$ is from about 0.8 to about 0.9.

20. The discharge tube of claim 17, wherein the radius "R" is from about 4 millimeters to about 15 millimeters.

21. The discharge tube of claim 17, wherein the ratio $D_1/D_2$ is from about 0.15 to about 0.3.

22. The discharge tube of claim 17, wherein the ratio $D_1/D_2$ is from about 0.18 to about 0.25.

23. The discharge tube of claim 17, wherein the first dimension $D_1$ is from about 1 millimeter to about 4 millimeters.

24. A discharge tube for a lamp comprising:

a body portion including a first end, a second end, and a tubular member defining an interior area, wherein the tubular member extends along an elongated axis between the first end and the second end, wherein the discharge tube has a circular periphery disposed at a radius "R" about the elongated axis; and a first end portion provided at the first end of the body portion, the first end portion including a first tapered portion that is tapered in a direction extending substantially perpendicular from the elongated axis, the first tapered portion including an interior surface facing the interior area, wherein the tapered portion spans between a maximum extent in the direction of the elongated axis and a minimum extent in the direction of the elongated axis, the minimum extent including a first dimension $D_1$ with respect to the interior surface and the maximum extent including a second dimension $D_2$ with respect to the interior surface, wherein the ratio $D_1/D_2$ is from about 0.18 to about 0.25 and the ratio $D_2/R$ is from about 0.8 to about 0.9.

* * * * *